US010837749B2

(12) United States Patent
Kruger

(10) Patent No.: US 10,837,749 B2
(45) Date of Patent: Nov. 17, 2020

(54) DETONATOR IDENTIFIER ASSIGNMENT

(71) Applicant: DETNET SOUTH AFRICA (PTY) LTD, Johannesburg (ZA)

(72) Inventor: Michiel Jacobus Kruger, Johannesburg (ZA)

(73) Assignee: DETNET SOUTH AFRICA (PTY) LTD, Johannesburg (ZA)

( * ) Notice: Subject to any disclaimer, the term of this patent is extended or adjusted under 35 U.S.C. 154(b) by 0 days.

(21) Appl. No.: 16/322,332

(22) PCT Filed: Aug. 2, 2017

(86) PCT No.: PCT/ZA2017/050040

§ 371 (c)(1),
(2) Date: Jan. 31, 2019

(87) PCT Pub. No.: WO2018/027247

PCT Pub. Date: Feb. 8, 2018

(65) Prior Publication Data

US 2019/0186885 A1 Jun. 20, 2019

(30) Foreign Application Priority Data

Aug. 2, 2016 (ZA) ..... 2016/05321

(51) Int. Cl.
*F42D 1/055* (2006.01)

(52) U.S. Cl.
CPC ..... *F42D 1/055* (2013.01)

(58) Field of Classification Search
None
See application file for complete search history.

(56) References Cited

FOREIGN PATENT DOCUMENTS

| | | | |
|---|---|---|---|
| EP | 2082184 | B1 | 6/2012 |
| WO | 2015168709 | A2 | 11/2015 |
| WO | 2015176080 | A2 | 11/2015 |
| WO | 2016037196 | A1 | 3/2016 |

OTHER PUBLICATIONS

International Preliminary Report on Patentability for PCT/ZA2017/050040, international filing date of Aug. 2, 2017, dated Jul. 11, 2018, 10 pages.
International Search Report for PCT/ZA2017/050040, international filing date of Aug. 2, 2017, dated Mar. 23, 2018, 5 pages.
Written Opinion for PCT/ZA2017/050040, international filing date of Aug. 2, 2017, dated Mar. 23, 2018, 10 pages.

*Primary Examiner* — Reginald S Tillman, Jr.
(74) *Attorney, Agent, or Firm* — Cantor Colburn LLP

(57) ABSTRACT

A plurality of detonators (22A-N) and a method of assigning a unique identifier to each of the detonators comprises connecting the detonators in parallel to one another at respective connection points on each of two signal-transmitting conductors of a harness which extends from a reference location to a plurality of boreholes in which the detonators are respectively positioned. The method includes measuring a parameter which varies with the lengths of the two conductors between the reference location and the respective two connection points, and generating a unique identifier for each respective detonator based on the measured parameter. The detonators include a memory unit (58), a voltage-controlled oscillator (60, 60P) which generates a signal at an output frequency determined by voltage applied to the two connection points, and a processor (50) which uses the output frequency to generate a unique identifier for the detonator, which identifier is transferred to the memory unit (58).

13 Claims, 3 Drawing Sheets

DETONATOR IDENTIFIER ASSIGNMENT

CROSS-REFERENCE TO RELATED APPLICATIONS

This application is a U.S. national stage application of International Application No. PCT/ZA2017/050040 entitled "DETONATOR IDENTIFIER ASSIGNMENT", which has an international filing date of 2 Aug. 2017, and which claims priority to South African Patent Application No. 2016/05321, filed 2 Aug. 2016.

BACKGROUND OF THE INVENTION

This invention relates to the generation and assignment of a unique identifier to each detonator in a blasting system which includes a plurality of detonators.

In one blasting technique detonators are sequentially connected to two wires in a blasting harness which traverses a blasting bench. An operator goes to each borehole and then connects a detonator to the harness. It is possible that identifiers are assigned to the detonators beforehand. Alternatively, the operator assigns a unique identifier, generated in any appropriate way, to each detonator in sequence. The identifier of each detonator is then tagged, i.e. collected in an instrument, and, subsequently, the identifiers are employed as reference parameters, as is known in the art, to establish a controlled blasting sequence.

Tagging of the detonators in this way can be laborious and time consuming. The approach is also prone to human error in that a blast bench can be difficult to traverse and a borehole in which a detonator is positioned can be overlooked. An object of the present invention is to address, at least to some extent, these aspects.

SUMMARY OF THE INVENTION

The invention provides a method of assigning a respective unique identifier to each of a plurality of detonators which are connected, in parallel to one another, to respective connection points on two elongate signal-transmitting conductors of a harness which extends from a reference location to a plurality of boreholes in which the detonators are respectively positioned, the method including the steps of:

(1) for each detonator, directly or indirectly measuring a parameter which is associated with the two conductors and which varies with the lengths of the two conductors between the reference location and the respective two connection points; and (2) using the parameter measurement to generate a unique identifier for the respective detonator.

The unique identifier may be transferred to a memory unit in the detonator at the time it is generated or subsequently thereafter. The unique identifier may be recorded in a mobile device for subsequent use in establishing a blasting system.

The signal-transmitting conductors may be of any suitable kind in which the parameter varies with the lengths of the conductors from the reference location. For example, the conductors may be electrically conductive and the parameter may be a resistance value of the conductors. Other parameters which are conductor dependent include electrical values such as capacitance and inductance.

In an alternative approach the parameter may be dependent on the lengths of the conductors in that the parameter may, for example, be a value in a signal which is impressed on the conductors. For example, a phase angle of an alternating signal on the conductors varies with distance and it is possible to measure the phase angle.

Conveniently, as indicated, the parameter is a resistance value.

The resistance of an electrical conductor, eg. of aluminium, copper, steel or any combination of conductive materials, increases with length provided the conductor has a uniform cross-section and has a homogenous composition. By way of example a copper conductor of the kind used in a blasting system has a resistance of about 120 Ohms/km. If a signal with constant known voltage (a reference voltage) is impressed on the conductors, for example at the reference location, then as the lengths of the conductors from the reference location increase, the voltage across the conductors decreases generally linearly. At each pair of connection points, a voltage measurement may be made and a deviation of this voltage measurement from the reference voltage is dependent on the lengths of the conductors between the connection points and the reference location, and is uniquely related to the location of the respective connection points.

Thus, in one form of the invention, the voltage on the two conductors is measured at a pair of connection points and the voltage measurement is used in the generation of a unique identifier for the respective detonator which is connected to the harness at these connection points.

Typically the voltage variation along the lengths of the conductors is relatively small. It is possible to make use of the reduced voltage which prevails at a respective pair of connection points, or of the difference between the reduced voltage and the reference voltage, to generate the respective identifier.

In one approach the measurement of the voltage prevailing at a respective pair of connection points, or a value derived therefrom, is used to control the operation of a voltage-controlled oscillator which is associated with the respective detonator. The frequency of the oscillator, which is voltage dependent, can be used in any appropriate way to generate a unique identifier. For example, a digital value of the generated frequency may be used as the identifier. Alternatively, a digital value which is determined by a variation of the generated frequency from a reference frequency can be used as a control input to generate a unique identifier. These techniques are exemplary only and are non-limiting.

The functioning of the voltage-controlled oscillator may be affected by ambient temperature conditions. Correction factors may be applied to the voltage-controlled oscillator in order to counter the effect of temperature drift on the functioning of the oscillator.

As the resistance of the conductors between the reference location and each set of connection points increases with the lengths of the conductors, the voltage at each set of connection points decreases in a manner which is generally linearly dependent on the length of the conductors. Thus at each set of connection points a unique voltage value prevails.

The invention also extends to a detonator which includes at least two connection points for connection to respective conductors in a harness, a memory unit, a voltage-controlled oscillator which generates a signal at an output frequency the value of which is dependent on a voltage applied to the two connection points, and a processor which uses the value of the frequency or a value derived therefrom to generate a unique identifier for the detonator which is transferred to the memory unit.

The detonator may include a temperature-compensating circuit for controlling the operation of the voltage-controlled oscillator in a manner which is substantially independent of ambient temperature.

A switching mechanism, responsive to the processor, may be included in the detonator. The switching mechanism may be operable to control the operation of the voltage-controlled oscillator, i.e. to turn the voltage-controlled oscillator off, or on. The voltage-controlled oscillator may be effectively disconnected from the remainder of the detonator when it is off in order to minimise current consumption.

BRIEF DESCRIPTION OF THE DRAWINGS

The invention is further described by way of example with reference to the accompanying drawings in which.

DESCRIPTION OF PREFERRED EMBODIMENT

Figure 1:
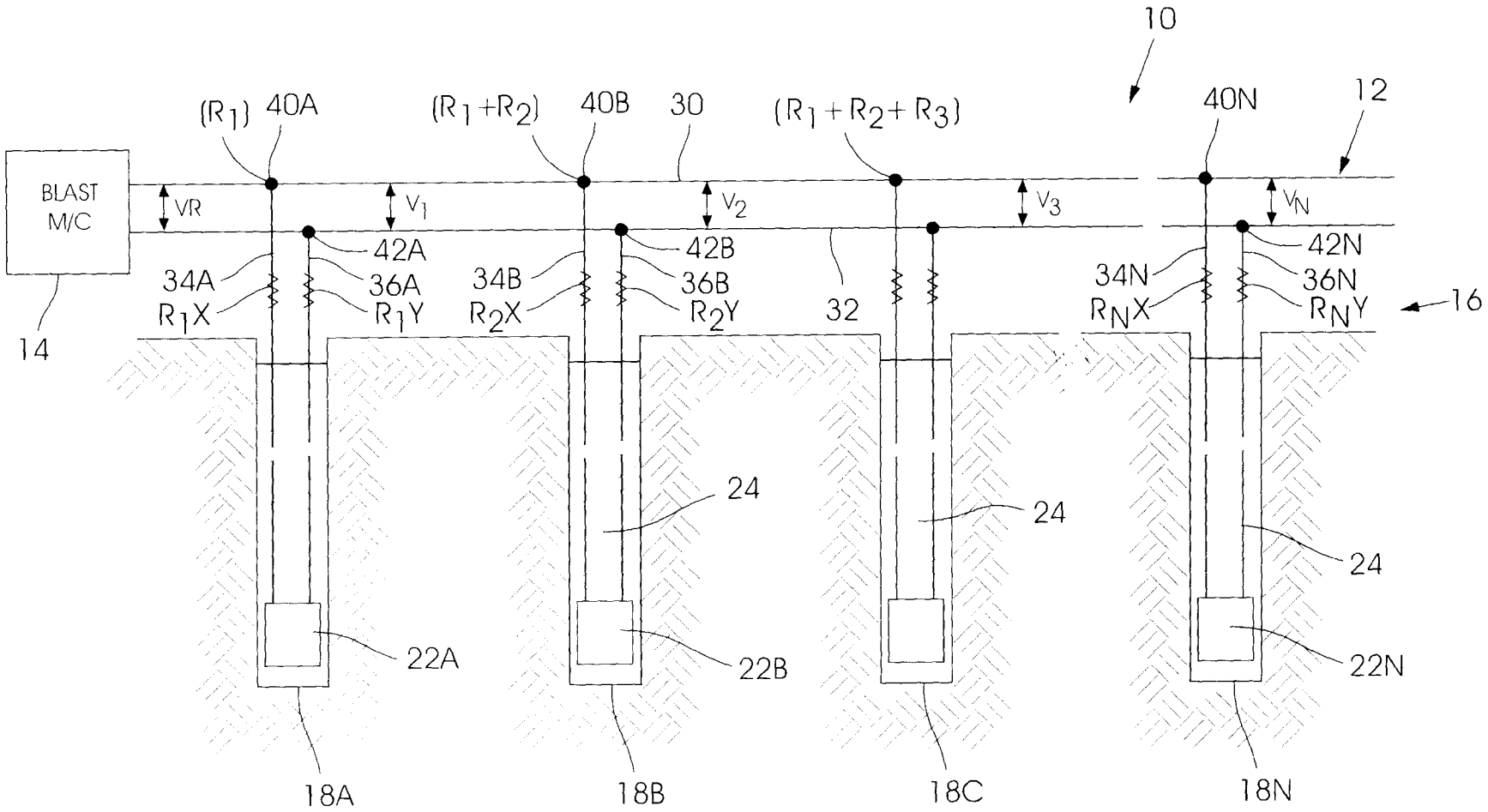
FIG. 1 is a schematic representation of a blasting system in which the principles of the invention are used.

FIG. 1 of the accompanying drawings illustrates a blasting system 10, according to the invention, which includes a harness 12 which extends from a blasting machine 14 over a blasting bench 16 to each of a plurality of boreholes 18A, 18B 18N. Each borehole contains a respective detonator 22A, 22B . . . 22N and explosive material 24.

The detonators are connected to two conductors 30 and 32 in the harness 12 by means of respective pairs of branch lines 34A and 36A, 34B and 36B, . . . and 34N and 36N, respectively.

The conductors 30 and 32 are elongate signal-transmitting conductors. In the following description the conductors are described as being electrically conductive and, typically, include electrically conductive metallic cores, eg. of copper. It should be understood however that this specific example is exemplary only. In general terms the principles of the invention can be used with any conductors in which a parameter of each conductor, or of a signal which is associated with the conductor, varies in a unique manner which is dependent on the length of the conductor, e.g. as the length of the conductor from the blasting machine 14 (which is referred to herein as a reference location) to a measurement point changes.

Each of the branch lines 34, 36 is connected to the conductors 30, 32 at respective connection points 40A, 42A; 40B, 42B; . . . ; 40N, 42N.

Figure 2:
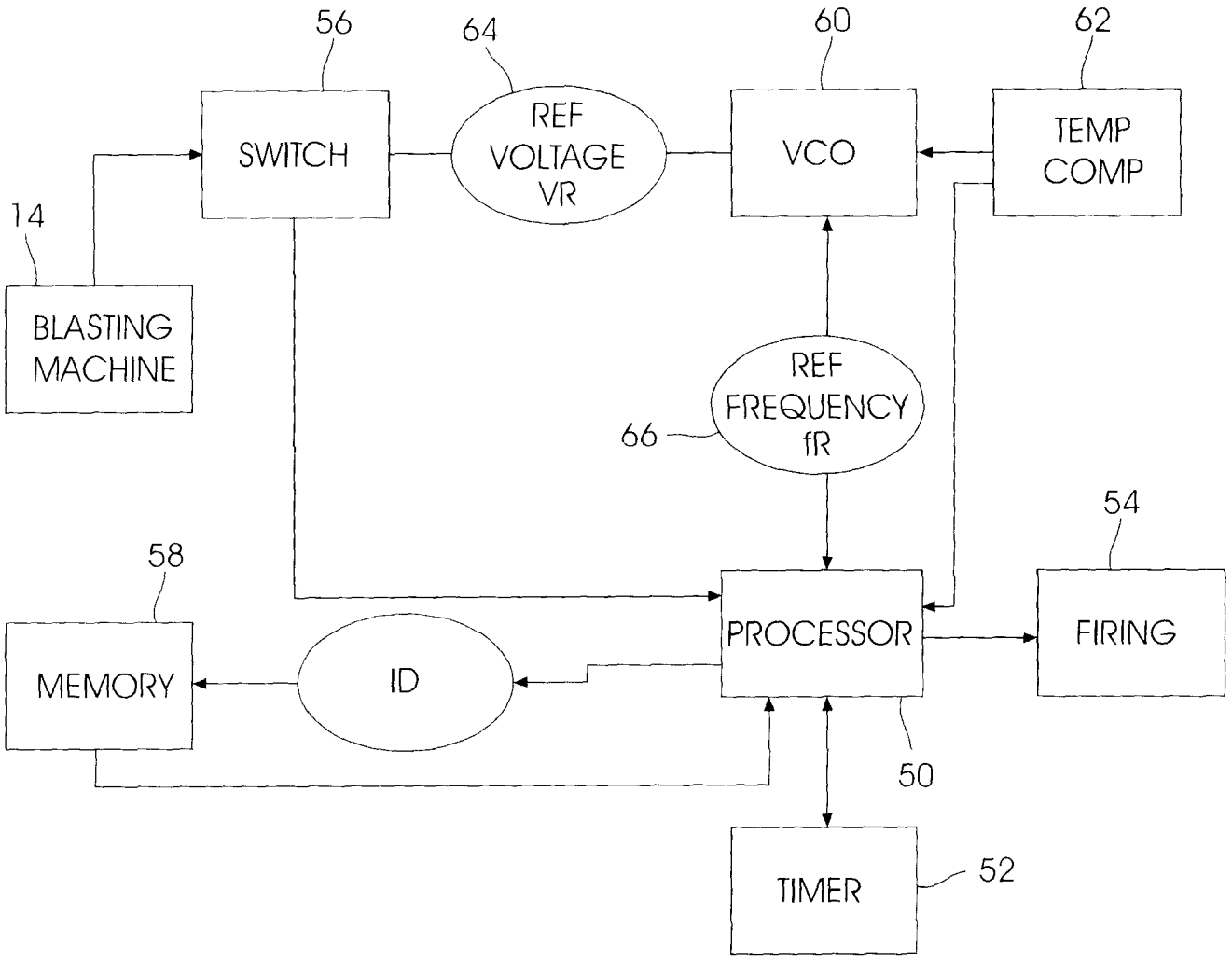
FIG. 2 is a block diagram configuration of elements in a detonator according to the invention.

FIG. 2 illustrates some components which are included in a detonator 22. The detonator 22 includes a processor 50 which embodies or which is connected to a timer 52. Using measuring techniques which are known in the art the processor 50 can control ignition of a firing circuit 54 in the detonator. The detonator 22 further includes a switching mechanism 56, a memory unit 58, a voltage-controlled oscillator 60 and a temperature-compensating circuit 62.

If the conductors 30 and 32 are respectively metallic, electrically-conductive, wires then it is possible to show the resistance in each wire, between predetermined connection points, as discreet values R1, R2, R3, . . . (FIG. 1). Proceeding from the blast machine 14 down the two wires 30 and 32 the resistance at the connection points 40A and 42A is R1; the resistance of the wires at the connection points 40B and 42B is R1+R2; the resistance at the connection points 40C and 42C is R1+R2+R3; and so on. R1X and R1Y denote the values of the resistances which are associated with the branch wires which lead from the connection points 40A and 42A on the conductors 30 and 32 to the detonator 22A, etc., i.e. the downline resistances.

In this example the invention is based on the premise that as the lengths of the wires between the blast machine and each respective pair of the connection points increases the resistance between the blast machine and the connection points, increases in a unique manner.

If the detonator is at the blasting machine 14 the lengths of the wires 30 and 32 between the blasting machine and the detonator are negligible. A reference voltage VR (designated 64 in FIG. 2) which is generated in the blasting machine 14 is applied to the voltage controlled oscillator 60 of the detonator upon closure of the switch 56. The oscillator 60 produces an output reference frequency fR (66) the value of which is directly dependent on the magnitude of the reference voltage VR. A signal containing data defining the output reference frequency 66 can then be sent to each detonator for storage in the respective memory 58.

Figure 3:
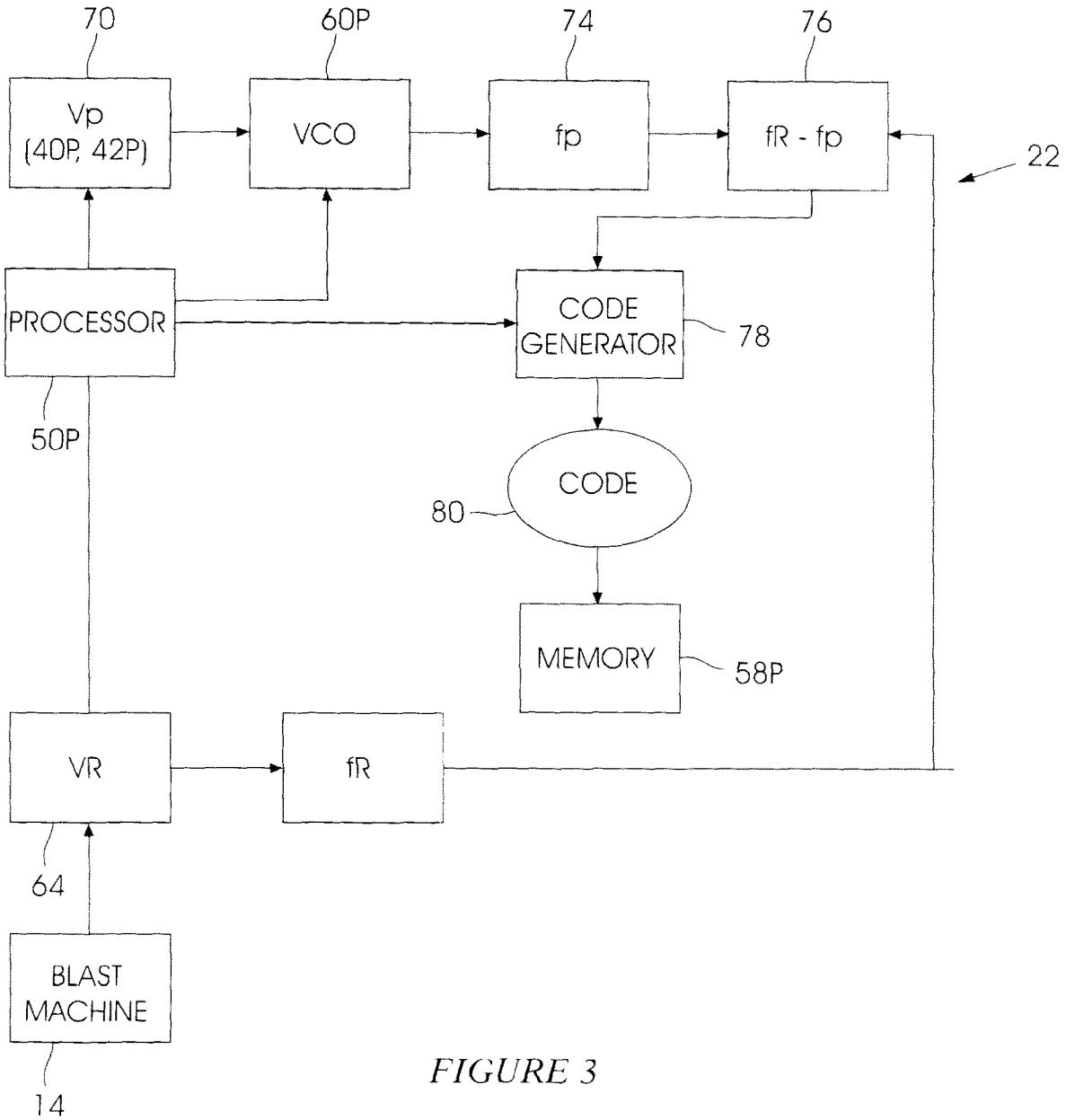
FIG. 3 is a simplified flowchart illustrating aspects of the invention.

In order to make use of this effect the constant reference voltage VR (64) (see FIG. 3) is impressed by the blasting machine 14 on the lines 30 and 32. At each set of connection points, say the connection points 40P and 42P, the voltage Vp (70) at the connection points is measured. As there is a volt drop along the line Vp is less than VR. The voltage measurement takes place under the control of the respective processor 50P in the detonator 22P. The measured voltage Vp (70) is applied to the voltage-controlled oscillator 60P in the detonator 22P which generates an output frequency fp (74). The value of fp is dependent on the value of Vp and typically is linearly linked to Vp. A difference 76 between the frequency values fR and fp is calculated from the fR value stored in the memory 58 and a measurement of the fp value is then applied to a code generator 78.

Alternatively but less preferably a measurement of the output reference frequency 66 is not transmitted to each detonator but is stored at the blasting machine 14. For each detonator data on the output frequency 74 is then sent to the blasting machine which calculates a code which is dependent on the difference between the frequencies 66 and 74 and this is used as an identifier for the particular detonator.

The nature of the code generator 78 can vary according to requirement. In one example the frequency difference 76 is directly used as a code for the respective detonator 22P. It is possible, for example, to generate codes in a numerically ascending, or descending, sequential order but in each instance the generated code is directly and uniquely linked to the frequency fp, possibly to the difference fR−fp.

A code 80 output by the code generator 78, is stored in the memory unit 58P of the detonator 22P.

The voltage-controlled oscillator 60P may for example function at an input voltage which ranges from, say, 8-12V and produce an output frequency in the kilohertz or megahertz range. Thus small voltage variations could produce substantial frequency variations which are measurable and which are uniquely linked to the resistances in the wires between the connection points and the reference location, i.e. the blasting machine 14.

In practice the operation of the voltage-controlled oscillator is normally temperature-dependent, i.e. frequency drift occurs due to ambient temperature variations. To compensate for this drift, the temperature-compensating circuit 62 is used to regulate the operation of the voltage-controlled oscillator 60.

The voltage-controlled oscillator 60 is only operative during the detonator identification generation process. Its current consumption is relatively high compared to the consumption of its detonator 22 when in a standby mode. To limit unnecessary current consumption the switch mechanism 56 is controlled by a signal from the blasting machine 14 to turn the voltage-controlled oscillator 60 on so that the identifier generation exercise can be initiated and to turn the voltage-controlled oscillator off once the identifier for a particular detonator has been generated and stored in the respective memory unit 58.

A significant benefit of the invention lies in the fact that once the detonators are connected to the harness it is not necessary for an operator to go to each detonator in order to tag each identifier or to load an identifier into the detonator. This translates into a substantial time saving in establishing a detonator network and also helps to eliminate human errors.

The invention thus makes use of a measurement which is length dependent. Not only does this feature allow for the generation of a unique identifier for each detonator but other advantages or benefits can be produced. For example it is possible to obtain a measurement of the distance between adjacent detonators. If the distance measurement is too high this would indicate that one or more detonators had not been placed into their respective boreholes. If a measurement is low this would indicate that adjacent detonators are close to one another. If it is known that this is not the case then the low distance measurement could be associated with current leakage to earth. If the characteristics of the conductors are known then with a reasonable degree of accuracy it is possible to predict what type of measurement should be produced when the identifier generation process is being implemented. Departures from this type of prediction are indicative of a fault of one kind or another.

As stated the calculations which determine an identifier for a detonator can be done at the detonator, or at the blasting machine 14 using data transmitted from the detonator.

Each detonator draws current from the blasting machine via the conductors to which the detonator is connected. This current consumption affects the nature of the voltage drop on the harness which is then non-linear. To address this aspect control equipment at the blasting machine 14 can be used to lower the voltage which is impressed on the harness so as to reverse bias a bridge provided at each detonator—a process which will result in negligible current consumption at each detonator, and so establish a voltage drop which is essentially linear with respect to length from the blasting machine.

Other factors which must be accounted for, to establish an accurate relationship of voltage variation (on the harness) with distance from the blasting machine inside the current consumption of each voltage controlled oscillator (VCO), and the current consumption of the downline wires (dependent on the values $R_N X$ and $R_N Y$ which in turn are related to the lengths of the downline wires), calibrations of the VCOs, etc.

Suitable calibration values are stored in the respective memory 58 of each detonator, or elsewhere if necessary, and are used as required to obtain an accurate length measurement and hence a reliable identifier generation for each detonator.

The invention claimed is:

1. A method of assigning a respective unique identifier to each of a plurality of detonators which are connected in parallel to one another to respective connection points with one such connection point being on each of two elongate signal-transmitting conductors to provide respective pairs of connection points, the two elongate signal-transmitting conductors comprising a harness which extends from a reference location to a plurality of boreholes in which the detonators are respectively positioned, the method including the steps of:

(1) for each detonator, directly or indirectly measuring a parameter which is associated with the two elongate signal-transmitting conductors and which varies with the lengths of the two elongate signal-transmitting conductors between the reference location and the respective pairs of connection points; and (2) using the parameter measurement to generate a unique identifier for respective detonators at the respective pairs of connection points;

characterized in that a signal with a reference voltage (VR) is impressed on the elongate signal-transmitting conductors at the reference location and at each of the respective pairs of connection points, a measurement of the voltage prevailing at a given pair of the connection points, or a value derived therefrom, is used to control the operation of a voltage-controlled oscillator which is associated with the respective detonator at the given pair of connector points, and in that the frequency (fp) of the voltage-controlled oscillator is used to generate the unique identifier.

2. A method according to claim 1 wherein the unique identifier is transferred to a memory unit in the respective detonator at the given pair of connection points.

3. A method according to claim 1 wherein the unique identifier is recorded in a mobile device for subsequent use in establishing a blasting system.

4. A method according to claim 1 wherein the elongate signal-transmitting conductors are such that the parameter varies with the lengths of the elongate signal-transmitting conductors from the reference location.

5. A method according to claim 4 wherein the two elongate signal-transmitting conductors are electrically conductive and the parameter is selected from the following: a resistance value, a capacitance value and an inductance value, of the two elongate signal-transmitting conductors.

6. A method according to claim 2 wherein the unique identifier is recorded in a mobile device for subsequent use in establishing a blasting system.

7. A method according to any one of claims 1 to 5 and 6 which includes the step of applying a correction factor to the voltage-controlled oscillator to counter the effect of temperature drift on the functioning of the oscillator.

8. A detonator which includes at least two connection points for connection to respective conductors in a harness, a memory unit, a voltage-controlled oscillator which generates a signal at an output frequency the value of which is dependent on a voltage applied to the two connection points, and a processor which uses the value of the frequency or a value derived therefrom to generate a unique identifier for the detonator which is transferred to the memory unit.

9. A detonator according to claim 8 includes a temperature-compensating circuit for controlling the operation of the voltage-controlled oscillator in a manner which is substantially independent of ambient temperature.

10. A detonator according to claim 8 which includes a switching mechanism, responsive to the processor which is operable to turn the voltage-controlled oscillator off, or on.

11. A detonator according to claim 8 which includes a switching mechanism to disconnect the voltage-controlled oscillator from the remainder of the detonator when the voltage-controlled oscillator is off in order to minimise current consumption by the detonator.

12. A method according to any one of claims 1 to 4 and 6 wherein the parameter is a value in a signal which is impressed on the conductors.

13. A method according to claim 12 which includes the step of applying a correction factor to the voltage-controlled oscillator to counter the effect of temperature drift on the functioning of the oscillator.

* * * * *